US009293809B2

(12) United States Patent
Teillet et al.

(10) Patent No.: US 9,293,809 B2
(45) Date of Patent: Mar. 22, 2016

(54) FORTY-FIVE DEGREE DUAL BROAD BAND BASE STATION ANTENNA

(75) Inventors: Anthony Teillet, Trabuco Canyon, CA (US); Hing Kan, Irvine, CA (US)

(73) Assignee: Intel Corporation, Santa Clara, CA (US)

( * ) Notice: Subject to any disclaimer, the term of this patent is extended or adjusted under 35 U.S.C. 154(b) by 740 days.

(21) Appl. No.: 13/494,662

(22) Filed: Jun. 12, 2012

(65) Prior Publication Data

US 2013/0002505 A1 Jan. 3, 2013

Related U.S. Application Data

(60) Provisional application No. 61/503,321, filed on Jun. 30, 2011.

(51) Int. Cl.

| | |
|---|---|
| ***H01Q 19/10*** | (2006.01) |
| ***H01Q 1/24*** | (2006.01) |
| ***H01Q 21/06*** | (2006.01) |
| ***H01Q 5/42*** | (2015.01) |

(52) U.S. Cl.

CPC ..... *H01Q 1/246* (2013.01); *H01Q 5/42* (2015.01); *H01Q 21/061* (2013.01); *H01Q 19/104* (2013.01)

(58) Field of Classification Search

CPC ..... H01Q 5/001; H01Q 21/061; H01Q 5/42; H01Q 1/246; H01Q 19/104

USPC ..... 343/835, 844, 853, 893, 810, 700 MS

See application file for complete search history.

(56) References Cited

U.S. PATENT DOCUMENTS

| | | | | |
|---|---|---|---|---|
| 5,966,102 | A * | 10/1999 | Runyon | 343/820 |
| 6,211,841 | B1 | 4/2001 | Smith et al. | |
| 6,937,191 | B2 * | 8/2005 | Puente Baliarda | 343/700 MS |
| 7,394,439 | B1 * | 7/2008 | Johnson et al. | 343/890 |
| 8,269,687 | B2 * | 9/2012 | Lindmark et al. | 343/810 |

FOREIGN PATENT DOCUMENTS

| | | |
|---|---|---|
| EP | 1227545 | 7/2002 |
| WO | 2007118211 | 10/2007 |
| WO | 2007136333 | 11/2007 |

OTHER PUBLICATIONS

Extended European Search Report in European application No. 12173565.8 dated Jul. 7, 2014, 6 pp.

* cited by examiner

*Primary Examiner* — Michael C Wimer

(74) *Attorney, Agent, or Firm* — Schwegman Lundberg & Woessner, P.A.

(57) ABSTRACT

The present invention relates to a multiband antenna specifically adapted for use with a Base Station Antenna ("BSA"). The present invention provides narrow azimuth or horizontal beamwidth ("HBW") having 45 degrees and operational over four frequency bands. The composite antenna topology and associated circuitry described in embodiments achieves reduced antenna installation requirements and allows for ease of network deployment or reconfiguration at reduced cost. Embodiments employ an array of low band radiating elements and two sets of high band radiating elements. The first set is co-located within an array of low band radiating elements. The second set of is offset and outside the low band radiating elements. An RF feed network energizes the first and second set of high band radiating elements to compensate for interference between the high and low band elements.

19 Claims, 13 Drawing Sheets

FORTY-FIVE DEGREE DUAL BROAD BAND BASE STATION ANTENNA

RELATED APPLICATION INFORMATION

The present application claims priority under 35 U.S.C. Section 119(e) to U.S. Provisional Patent Application Ser. No. 61/503,321 filed Jun. 30, 2011, the disclosure of which is incorporated herein by reference in its entirety.

BACKGROUND OF THE INVENTION

1. Field of the Invention

The present invention is related in general to radio communication systems and components. More particularly, the invention is directed to antenna arrays for wireless communication networks.

2. Description of the Prior Art and Related Background Information

Composite band antennas may be employed in multiband basestations for mobile communication systems to serve up to four different systems operating simultaneously on four different bands. For example, Global System for Mobile Communication ("GSM"), Digital Cellular Systems 1800 ("DCS1800"), and Universal Mobile Telecommunications System 2100 ("UMTS-2100") systems currently coexist in Europe, and emerging fourth generation systems (e.g., Long Term Evolution ("LTE")) will require separate antennas for communication with user equipment. Similarly in North America, Cellular 850 and Personal Communications Service 1900 ("PCS-1900") systems are deployed with LTE-700 and 2100 systems will be deployed in near future. It is not uncommon to have separate antennas being used for two separate bands where antennas are stacked one above another or placed in a side-by-side arrangement. Alternatively, the antennas may be packaged as a single assembly. Conventional solutions may result in relatively large structures which are typically not favored by local municipalities. In general, base station structures should be as small and as inconspicuous as possible.

Accordingly, a need exists to provide compact composite band antenna structures.

SUMMARY OF THE INVENTION

In a first aspect, the present invention provides an antenna assembly. The antenna assembly comprises a reflector, an array of first frequency band radiating elements configured above the reflector, the elements arranged in one or more columns extending in a first direction, and a plurality of second frequency band radiating elements configured above the reflector including first and second sub groups, each of the first sub group of radiating elements essentially co-located with a corresponding first frequency band radiating element, and wherein the second sub group of radiating elements are configured outside of the first frequency band radiating elements, the second sub group offset with respect to the first sub group of radiating elements in the first direction. The antenna assembly further comprises an RF feed network coupled to each radiating element of the first and second sub groups, the RF feed network providing a first communication signal having a first power level to the first sub group, the RF feed network providing a second communication signal having a second power level differing from the first power level to the second sub group. The operating frequency of the first frequency band radiating elements is lower than the operating frequency of the second frequency band radiating elements.

In a preferred embodiment, the first and second sub groups of radiating elements are arranged in three columns. The first power level is preferably greater than the second power level. The array of first frequency band radiating elements is preferably arranged in two columns. The first power level is preferably approximately −3.3 dB below an RF input level and the second power level is preferably approximately −6.7 dB below the RF input level. The RF feed network preferably further comprises a phase shifter receiving a first input signal and outputting a phase adjusted signal, and a plurality of first divider-combiner manifolds receiving the phase adjusted signal and outputting the first communication signal having the first power level to the first sub group, the first divider-combiner manifolds outputting the second communication signal having the second power level to the second sub group. The first and second sub groups of radiating elements are preferably each coupled to two independent high frequency radio frequency ("RF") ports and the array of first frequency band radiating elements are each coupled to two lower frequency RF ports. The second sub group of radiating elements preferably form a series of radiating doublets having a radiating emission pattern narrower than that of the first sub group of radiating elements. The first and second sub groups of radiating elements preferably form a series of radiating triplets. The radiating elements of the first and second sub groups collectively provide a radiation pattern of about 40-50 degrees Half Power Beamwidth.

In another aspect, the present invention provides an antenna assembly. The antenna assembly comprises a reflector and an array of first frequency band radiating elements configured above the reflector, the array arranged in pairs forming first and second columns both having lengths in a first direction. The antenna assembly further comprises a plurality of second frequency band radiating elements including a first sub group of radiating elements configured above the reflector, the first sub group of radiating elements arranged as a column having a length in the first direction, each of the first sub group of radiating elements essentially co-located with a corresponding radiating element of the first column of the array of first frequency band radiating elements, and a second sub group of radiating elements configured above the reflector arranged in pairs forming two columns on either side of the first sub group of radiating elements in a direction orthogonal to the first direction, the second sub group positioned outside corresponding radiating elements of the first column of the array of first frequency band radiating elements. The antenna assembly further comprises a plurality of third frequency band radiating elements including a third sub group of radiating elements configured above the reflector, the third sub group arranged as a column having a length in the first direction, each of the third sub group of radiating elements essentially co-located with a corresponding radiating element of the second column of the array of first frequency band radiating elements, and a fourth sub group of radiating elements configured above the reflector as an array arranged in pairs forming two columns on either side of the third sub group of radiating elements in a direction orthogonal to the first direction, the fourth sub group positioned outside corresponding radiating elements of the second column of the array of first frequency band radiating elements. The operating frequency of the second and third frequency band radiating elements is higher than the operating frequency of the first frequency band radiating elements.

In a preferred embodiment, the antenna assembly further comprises an RF feed network coupled to each radiating element of the first, second, third, and fourth sub groups, the network providing a first communication signal having a first power level to the first sub group, the network providing a second communication signal having a second power level differing from the first power level to the second sub group, the network providing a third communication signal having a third power level to the third sub group, the network providing a fourth communication signal having a fourth power level differing from the third power level to the fourth sub group. The first power level is preferably greater than the second power level and the third power level is greater than the fourth power level. The operating frequency band of the first and second sub groups may be the same as the operating frequency band of the third and fourth sub groups or the operating frequency band of the first and second sub groups may differ from the operating frequency band of the third and fourth sub groups. The first and second sub groups of radiating elements and third and fourth sub groups of radiating elements each have collectively a radiating emission pattern of about 40-50 degrees Half Power Beamwidth. The second and fourth sub groups of radiating elements preferably form a series of radiating doublets having a radiating emission pattern narrower than that of the first and third sub groups of radiating elements. The first and second sub groups of radiating elements preferably form a first series of radiating triplets, wherein the third and fourth sub groups form a second series of radiating triplets. The radiating elements of the first, second, third, and fourth sub groups preferably comprise patch elements.

In another aspect, the present invention provides a method of operating a multi band antenna comprising an array of low band radiating elements, a first set of high band radiating elements each co-located within a corresponding low band radiating element, and a second set of high band radiating elements positioned outside the low band radiating elements. The method comprises providing a first frequency RF communication signal to an array of low band radiating elements, providing a second higher frequency RF communication signal having a first power level to a first set of high band radiating elements each co-located with a corresponding low band radiating element, and providing the second higher frequency RF communication signal having a second power level to a second set of high band radiating elements positioned outside the low band elements, wherein the first power level differs from the second power level to compensate for increased beamwidth caused by co-location of the first set of high band radiating elements with corresponding low band radiating elements.

Further features and aspects of the invention are set out in the following detailed description.

DETAILED DESCRIPTION OF THE INVENTION

Figure 1:
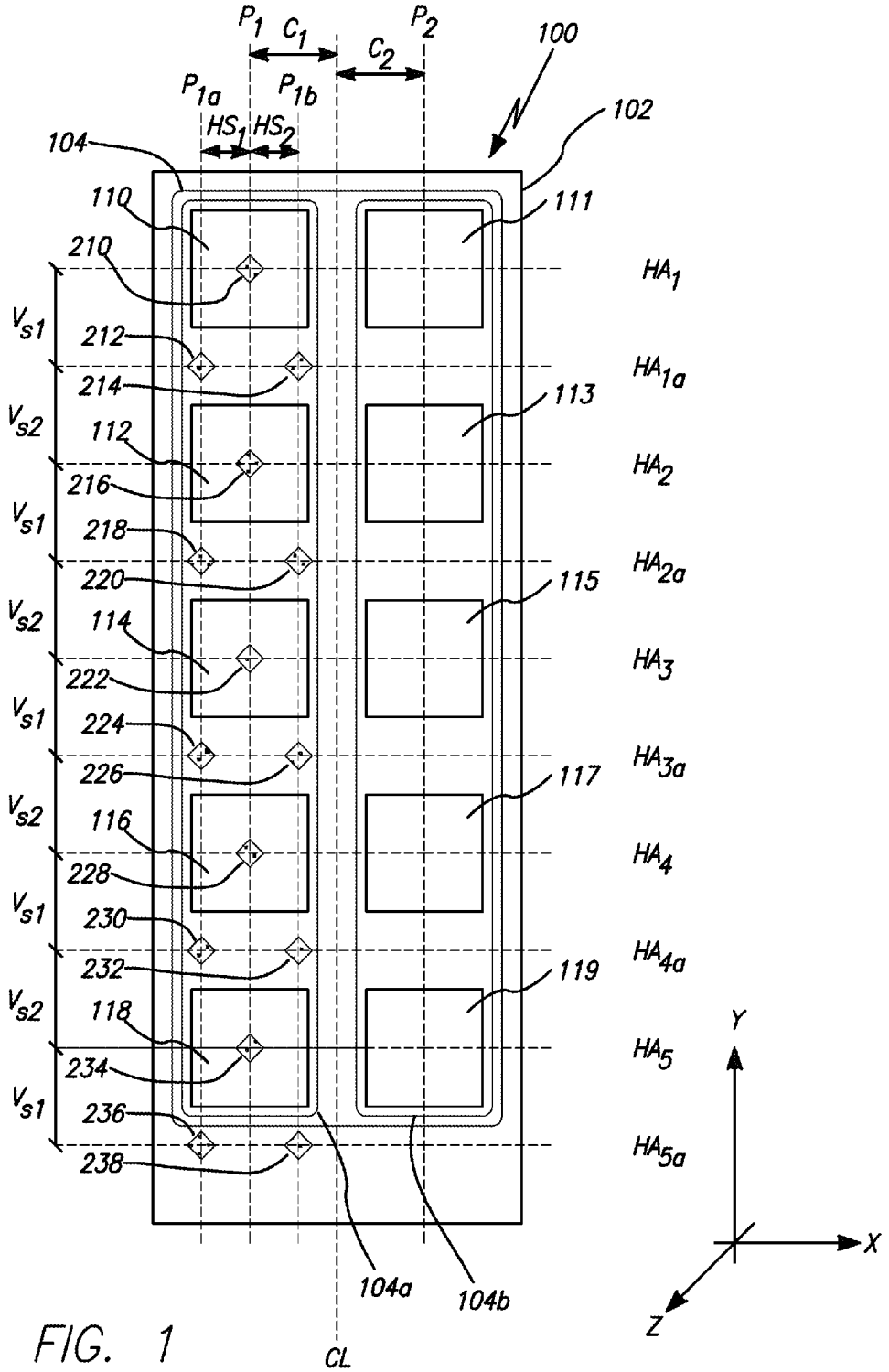
FIG. 1 is a front, boresight view of an exemplary dual broadband quad-port antenna.

Embodiments of the invention provide a multiple frequency band, dual cross polarization base station antenna ("BSA") arrangement exhibiting a narrow azimuth or horizontal plane beamwidth ("HPBW") of approximately 45 degrees and an operable signal coverage in two non-overlapping frequency blocks. A block may include at least one or more communication bands. For example, a low frequency block may contain FB1=700 LTE and FB2=850 WCDMA, while a high frequency block may include FB3=1900 PCS, FB4=2100 AWS, and FB5=2600 LTE. While providing broadband operation, the antenna system shall be capable of low coupling between different frequency bands while at the same time minimizing the space needed as compared to conventional antennas. A first preferred embodiment of such an antenna may be provided with four RF feed ports. A second preferred embodiment may be capable of operation in a low frequency block and two independent high frequency blocks. It shall be understood that both the foregoing general description and the following detailed description are exemplary and are not restrictive of the present invention as claimed.

Other objects, advantages, and novel features of one or more embodiments will become more apparent from the following detailed description when taken in conjunction with the accompanying drawings.

Embodiments seek to provide simultaneous quad frequency band operation for a cellular basestation antenna having a shared reflector and radome. Embodiments also seek to provide such an antenna which has minimum dimensions while providing 45 degree azimuth beamwidth for each band. Even though exemplary embodiments describe an antenna with 45 degree azimuth beamwidth, embodiments may be easily reconfigured to achieve azimuth beamwidth between 40 and 50 degrees. The desired azimuth beamwidth may be achieved by changing element spacing, altering power signal division, or as a combination of antenna element spacing and power signal division.

Embodiments of a multiple frequency band antenna arrangement may be connected to a transceiver or a bank of transceivers for transmitting and receiving RF signals in at least four separate frequency bands. A first preferred antenna arrangement may have two sets of antenna elements arranged on a common reflector. A first set of antenna elements is arranged in a side-by-side column arrangement which operates in a first frequency region, whereas a second set of antenna elements is arranged in a tri-column arrangement and operates in a second frequency region. Embodiments may include first and second sets of antenna elements interleaved along and positioned on a first vertical axis parallel with the Z-axis so as to form a first column.

Embodiments are described below with reference to the accompanying drawings. Specifically, the embodiments described below are exemplary only, without covering all possible embodiments. A person having ordinary skill in the art can derive other embodiments from the embodiments provided herein without making any creative effort, and all such embodiments are covered within the scope of the present invention.

Figure 2:
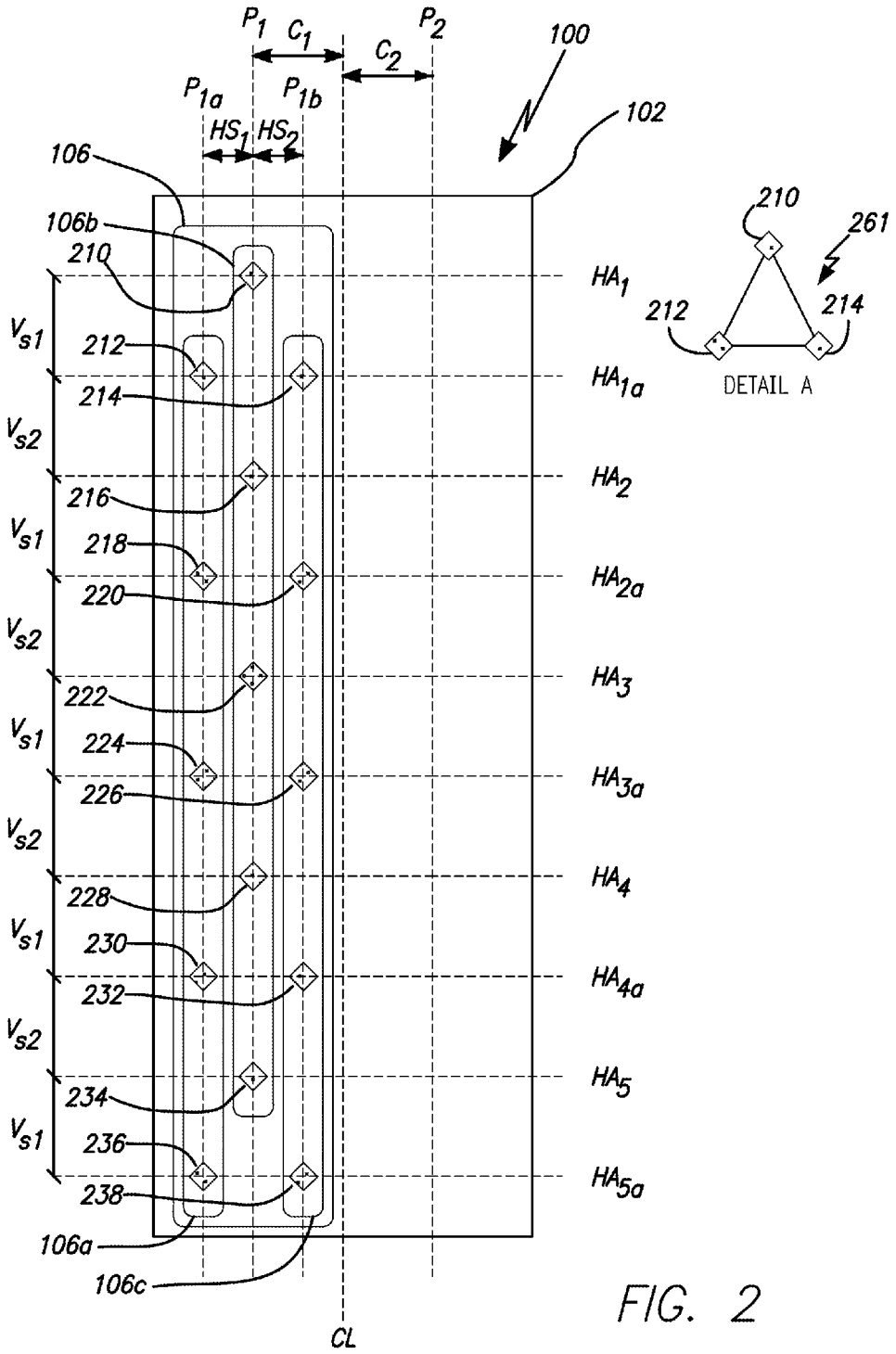
FIG. 2 is a front, boresight view of the dual broadband quad-port antenna showing only high band antenna elements and their arrangement.

Referring to FIGS. 1 and 2, a structure of a multiband antenna 100 for transmitting and receiving electromagnetic signals is disclosed. The multiband antenna 100 includes a reflector 102 and a first band dual-polarized antenna elements group 104, and a second band dual-polarized antenna elements group 106 arranged along reflector 102 outwardly positioned surface, generally in the direction of the main radiation beam of the antenna. In the embodiment shown, dual-polarized antenna elements groups 104 and 106 radiate in the two polarization planes P which are perpendicular with respect to one another and are perpendicular to the reflector plane and positioned longitudinally along major length alignment axes $P_{1a}$, $P_1$, $P_{1b}$, and $P_2$ on the front surface of the radiator arrangement which is rectangular in a plan view. As such, each low frequency antenna element 110, 111, 112, 113, 114, 115, 116, 117, 118, and 119 have two independent RF ports used for coupling RF signal to and from the antenna elements via suitably constructed RF wave guides.

With regard to the construction and mode of functioning of such an antenna element type, reference is made, for example, to WO 2009108097 A1, incorporated herein by reference in its entirety. However, any radiator or radiator type can be used in the scope of the invention, in particular patch radiators, or dipole arrangements may be used as a suitable antenna element.

FIG. 1 illustrates an antenna arrangement based on a rectangular reflector 102. To facilitate ease of discussion, the outward pointing face of reflector 102 is oriented along the Z-axis, while the longitudinal or lengthwise dimension of the reflector 102 is set along the Y-axis with latitudinal or widthwise dimension is set along the X-axis. The reflector 102 can be constructed using conventional means such as by utilizing conductive materials such as aluminum or steel alloys. Alternatively, composite material construction can be implemented. As shown in the plan views of FIGS. 1 and 2, only antenna elements groups 104 and 106 can be viewed with the feed networks, to be discussed later, positioned on the back side of the reflector 102.

The first antenna element group 104 will now be described. The first antenna element group 104 is comprised of two columns of antenna elements 110-118, 111-119 arranged along the first $P_1$ and second $P_2$ vertical alignment axes. In the preferred embodiment, the first $P_1$ and second $P_2$ alignment axes are set equidistantly and parallel (i.e., $C_1=C_2$) about the reflector 102 longitudinal center line ("CL"). However these dimensions can be altered to achieve performance goals (i.e. $C_1 < > C_2$). As viewed in FIG. 1, the first antenna element group 104 comprises a first subgroup 104*a* of antenna elements 110, 112, 114, 116, 118 positioned along first $P_1$ alignment axis, while second subgroup 104*b* of antenna elements 111, 113, 115, 117, and 119 positioned along second $P_2$ alignment axis and paired along horizontal $HA_1$, $HA_2$, $HA_3$, $HA_4$, and $HA_5$ alignment axes. Within each antenna element sub group, adjacent antenna elements are spaced vertically along the Y-axis by distance $V_{s1}+V_{s2}$ and horizontally along the X-axis by a distance $C_1+C_2$. In an embodiment, ten antenna elements 110 to 119 are employed, however the number of antenna elements can be increased or decreased without departing from the scope of the present invention.

The second antenna element group 106 will now be described. The second antenna element group 106 comprises three columns of antenna elements 210-238 arranged along first $P_{1a}$, second $P_1$, and third $P_{1b}$ vertical alignment axes. As illustrated in FIGS. 1 and 2, the second antenna element group 106 comprises a first subgroup 106*a* of antenna elements 212, 218, 224, 230, and 236 positioned left along the $P_{1a}$ alignment axis. A second subgroup 106*b* of antenna elements 210, 216, 222, 228, and 234 are positioned along the $P_1$ alignment axis. A third subgroup 106*c* of antenna elements 214, 220, 226, 232, and 238 are positioned along the right $P_{1b}$ alignment axis. The second subgroup 106*b* antenna elements 210, 216, 222, 228, and 234 are centrally co-located with first subgroup 104*a* of antenna elements 110, 112, 114, 116, and 118 of the first antenna group 104 positioned along first vertical $P_1$ alignment axis, and along the horizontal $HA_1$, $HA_2$, $HA_3$, $HA_4$, and $HA_5$ alignment axes.

With regard to the construction and mode of functioning of such co-located antenna element type, reference is made, for example, to WO 2007011295 A1, incorporated herein by reference in its entirety. As such, each high frequency antenna element such as antenna elements 210, 212, and 214 have two independent RF ports used for coupling RF signals to or from the antenna elements via suitably constructed RF wave guides. In general, the co-located antenna elements 210, 216, 222, 228, and 234 tend to have a HPBW of 65 degrees over a wide frequency range. Due to construction techniques used to co-locate antenna elements 210, 216, 222, 228, and 234, such placement may limit the degree of freedom afforded to those skilled in the art to alter basic antenna element design without affecting performance parameters of the lower frequency band antenna elements 110, 112, 114, 116, and 118. To achieve 45 degrees HPBW for high band antenna array, the HPBW of 65 degrees of the co-located antenna elements 210, 216, 222, 228, and 234 must be compensated. In one or more embodiments, a doublet of horizontally positioned antenna elements such as antenna elements 212 and 214 each having HPBW of 65 degrees are placed along horizontal alignment axis $HA_{1a}$ below the co-located antenna elements such as antenna element 210 which is placed on the horizontal alignment axis $HA_1$. Alignment axes $HA_1$ and $HA_{1a}$ are separated vertically by a distance $V_{s1}$. $HA_{1a}$ and $HA_2$ are separated by a vertical distance $V_{s2}$. The horizontally positioned antenna elements such as antenna elements 212 and 214 are equidistant from longitudinal alignment axis $P_1$ and separated from the $P_1$ axis by a distance $HS_1$ and $HS_2$. The resultant antenna element doublet such as that formed by antenna elements 212 and 214 has a narrow HPBW of 26 to 38 degrees as shown in FIG. 6B over a wide frequency range. Effectively, the narrow HPBW of the high frequency antenna element doublet 212 and 214 is advantageously combined with HPBW of the co-located antenna elements 210 by altering RF feed network which results an antenna element group 106 array having a desired 45 degrees HPBW as shown in FIG. 6C.

The first and third subgroup 106*a* and 106*c* elements are positioned along horizontal alignment axes $HA_{1a}$, $HA_{2a}$, $HA_{3a}$, $HA_{4a}$, and $HA_{5a}$ generally vertically spaced from above alignment axes $HA_1$, $HA_2$, $HA_3$, $HA_4$, $HA_5$ by a distance $V_{s1}$ such that the distance, for example, between $HA_1$ and $HA_{1a}$ is $V_{s1}$ and $HA_{1a}$ and $HA_2$ is $V_{s2}$. It should be noted that $V_{s1}$ and $V_{s2}$ may be unequal to achieve performance goals or to further optimize antenna array performance parameters.

In one preferred embodiment, a patch element may be employed as a unitary antenna element, but other suitable radiating structures such dipoles or horns may be employed. A wide bandwidth patch element is well known in the art and tends to exhibit a 65 degree azimuth beamwidth (HPBW) over a wide frequency range where approximately 40% of the bandwidth has been achieved at 1 dB directivity roll off with VSWR better than 1.8:1 over the same frequency span. Patch element design can be altered to exhibit azimuth beamwidth other than 65 degrees, but such a modification reduces the patch element useful frequency bandwidth over which the azimuth beamwidth remains nearly constant (i.e. within the design azimuth beamwidth). The problem is especially acute when antenna elements are combined into an array. The effective array antenna array beamwidth is also affected when multiple arrays share the same radiator structure to achieve a multi-band capable antenna. To solve the aforementioned problem, embodiments employ optimized patch elements exhibiting 65 degree azimuth beamwidth over a wide frequency range to achieve 45 degree azimuth beamwidth over nearly 40% bandwidth in two separate, non-overlapping frequency bands with an RF combining network providing RF signals with differing power levels which will be described later. It should be noted the embodiment of the present invention can be altered to provide an antenna array between 30 and 50 degrees.

Figure 6A:
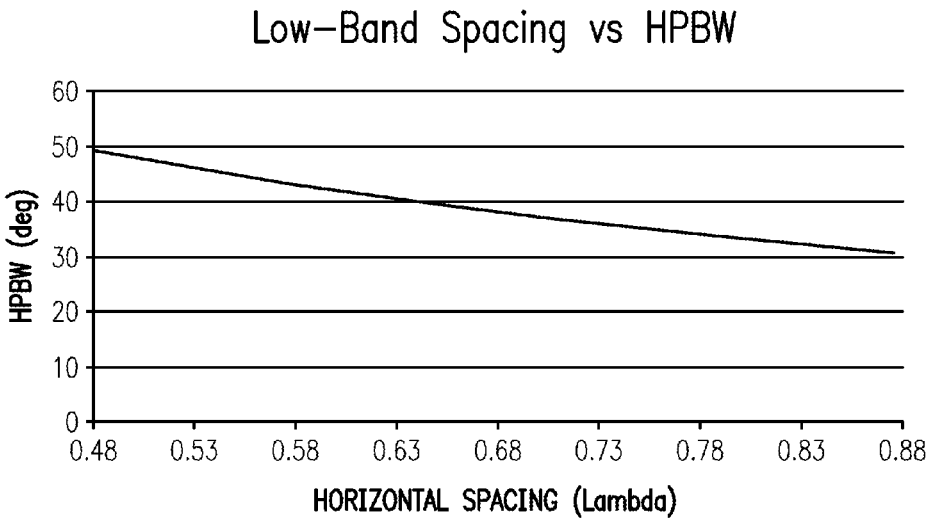
FIG. 6A is a representation of simulated performance of the HPBW as a function of horizontal spacing (lamba) for horizontal spacing of low band antenna elements in low band antenna array.
Figure 6B:
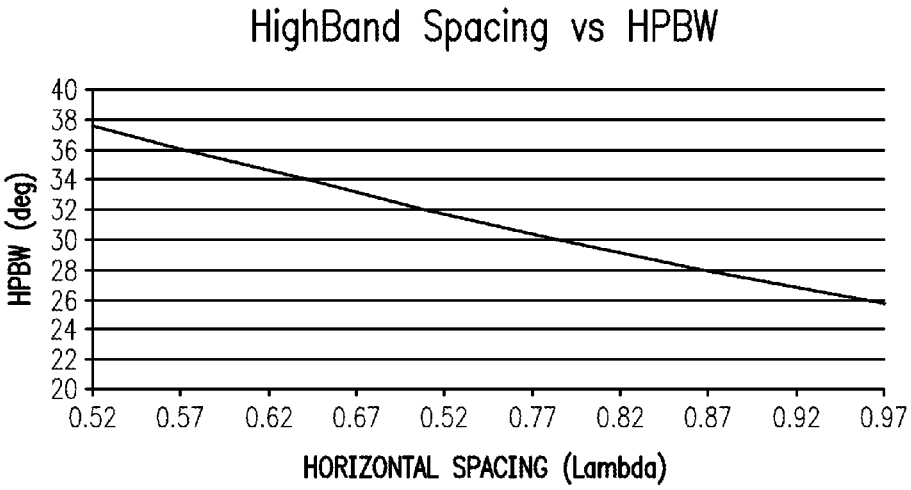
FIG. 6B is a representation of simulated performance for the HPBW as a function of horizontal spacing (lambda) for high band, horizontal doublet of antenna elements (i.e., for a pair).
Figure 6C:
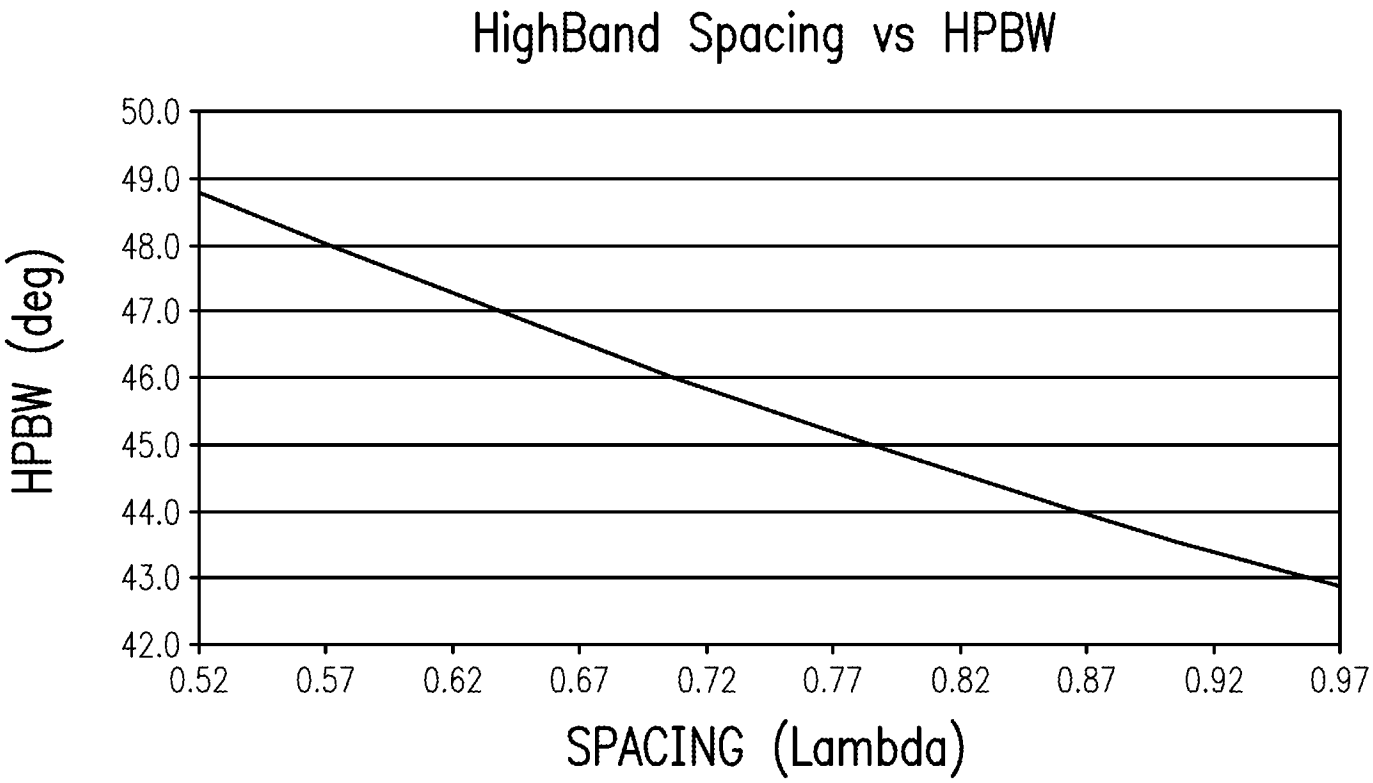
FIG. 6C is a representation of simulated performance for the HPBW as a function of horizontal spacing (lambda) for high band antenna array, vertical spacing between co-located high band element and doublet of high band elements.

With respect to the low frequency antenna elements group 104 with horizontal element spacing $C_1$+$C_2$, a 45 degree HPBW is achieved when spacing is set at 0.54 lambda (i.e., the wavelength of the radiation) as depicted in FIG. 6A provided that broadside antenna element pairs such as pairs 110 and 111 are equally fed and in phase. Accordingly, in an exemplary antenna, there are five doublet groups of low band antenna elements as shown in Table I.

TABLE I

| Group | Antenna Elements |
|---|---|
| 1A | 110 and 111 |
| 2A | 112 and 113 |
| 3A | 114 and 115 |
| 4A | 116 and 117 |
| 5A | 118 and 119 |

It has been determined that low band antenna elements do not suffer adverse radiation pattern affects from having high band elements positioned within. The same is not true for high band elements (e.g., antenna element 210) which are positioned centrally within larger low band elements (e.g., antenna element 110).

Figure 3:
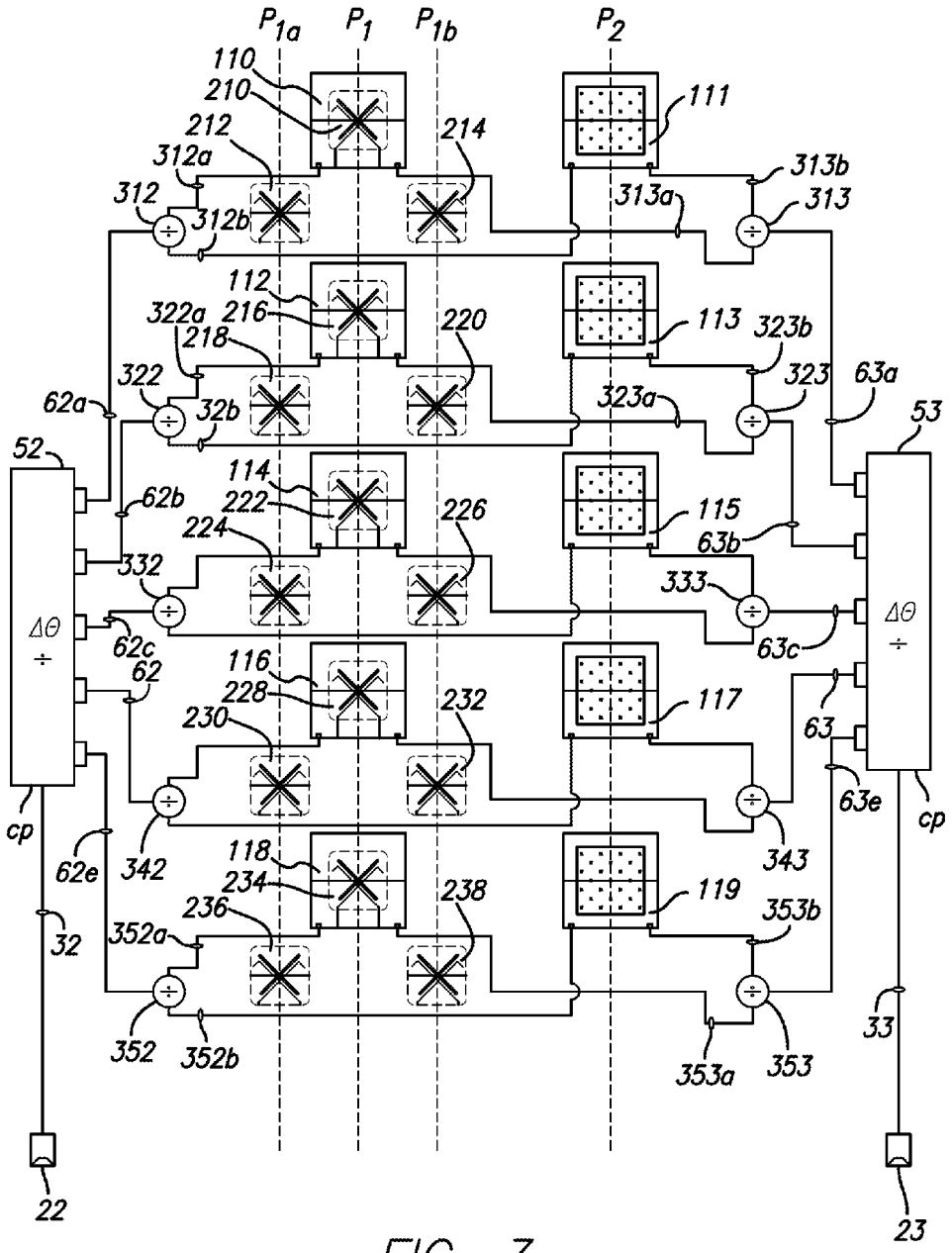
FIG. 3 is a block schematic diagram of a low band RF feed structure with the high band RF feed structure omitted for clarity.
Figure 5:
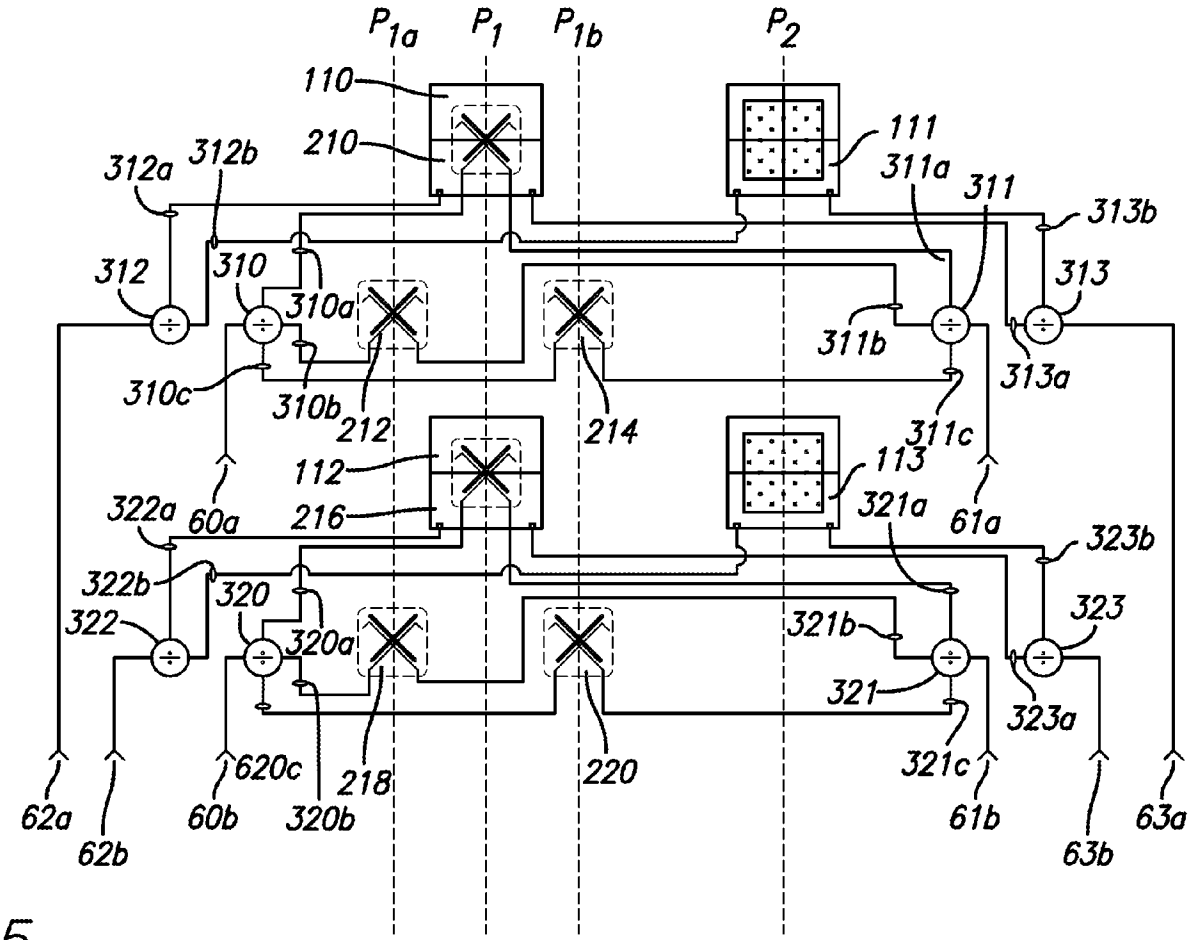
FIG. 5 is a block schematic diagram of a portion of the high and low band antenna element RF feed structure (from phase shifter to antenna element) shown together for a subset of antenna elements.

With reference to FIGS. 3 and 5, two way −3 dB splitters 312, 313, 322, 323, 332, 333, 342, 343, 352, and 353 are provided. An equal output RF splitter is well known in art for example a Wilkinson divider/combiner—but other well known splitter combiners may be implemented. The two splitter output ports 312*a* I 312*b*, 313*a* I 313*b*, 322*a* I 322*b*, and 323*a* I 323*b* are coupled to respective antenna elements 110-119 feed ports. The splitter common port is coupled to a designated phase shifter 52 and 53 ports via suitably constructive radio wave guides such as waveguides 62*a*-62*e* and 63*a*-63*e* known in the art. The phase shifter 52 and 53 are used as signal—divider combiners that provide controllable phase shift along its output ports relative to its input port (cp). The aforementioned phase shifters 52 and 53 are used to provide electrical beam tilt function and has been disclosed in WO 96/037922 and WO 02103561 assigned to present assignee, each incorporated herein wholly by reference in its entirety.

As it was briefly mentioned above, high band antenna elements such as antenna elements 210 and 216 that are positioned within low frequency band elements such as antenna elements 110 and 112 have altered radiation patterns albeit slightly. Interposed high band element pattern augmentation is addressed by employing a paired high band antenna elements such as antenna elements 212 and 214 positioned below interposed high band element such as antenna element 210 forming a triplet group 261 or triangular arrangement of three high band elements such as antenna elements 210, 212, and 214 that are commonly fed. In an exemplary antenna, there are five triplet groups of high band antenna elements as shown in Table II. The phase shifter common ports 52*cp* and 53*cp* are coupled to a corresponding antenna system having RF connectors 22 and 23 coupled to suitably constructed RF guides such as coaxes 32 and 33.

TABLE II

| Group | Antenna Elements |
|---|---|
| 1B (261) | 210, 212, and 214 |
| 2B | 216, 218, and, 220 |
| 3B | 222, 224, and, 226 |
| 4B | 228, 230, and 232 |
| 5B | 234, 236, and 238 |

To achieve the desired HPBW, such as 45 degrees for example, from the triplet group 261 of antenna elements 210, 212, and 214, it is necessary to provide an un-equal signal combining—dividing distribution network between the phase shifters 50 and 51 and the respective triplet groups.

Figure 4:
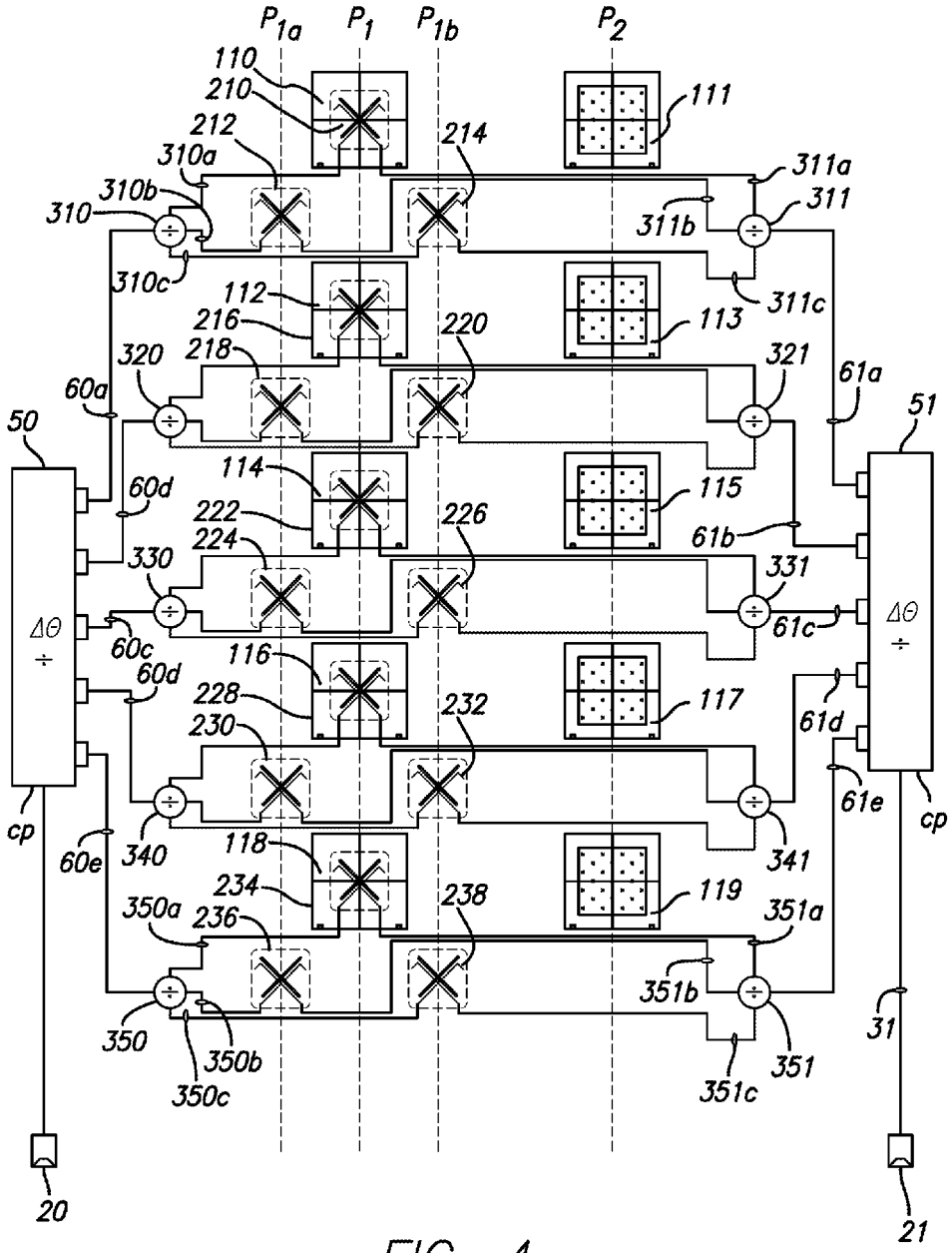
FIG. 4 is a block schematic diagram of a high band RF feed structure with the low band RF feed structure omitted for clarity.

With reference to FIGS. 4 and 5, a high band feed network will be described. The triplet group 261 comprises antenna elements 210, 212, and 214. Together, five of such antenna elements groups or triplets are used to form a broadband antenna. The centrally located high band antenna element such as radiating element 210 has HPBW pattern altered due to its placement within the perimeter of the low band antenna element 110. In general, design of stacked, dual band patch based antenna elements involves techniques which result in HPBW augmentation that single band patch antenna elements do not experience. Further modifications of high band antenna elements such as antenna element 210 may impact performance of the low band antenna elements such as antenna element 110 which may require additional design constraints. To overcome performance constraints, a pair of high band antenna elements 212 and 214 spaced vertically $V_{s1}$ (i.e., parallel with the Y axis) below centrally located high band antenna element 210 and horizontally (i.e., parallel with the X axis) spaced $H_{s1}$ and $H_{s2}$ apart from the common alignment axis $P_1$. The spacing $H_{s1}$ and $H_{s2}$ horizontal spacing define high band antenna elements vertical alignment axes P1*a* and $P_{1b}$ respectively. The combination of vertical $V_{s1}$ and horizontal spacing $H_{s1}$ and $H_{s2}$ define relative position of two high band antenna elements 212, 214. To achieve desired HPBW, for example 45 degrees the antenna elements 210, 212, 214 of the triplet group 261 are provided with unequal signal split provided by divider—combiner manifolds 310, 311, 320, 321, 330, 331, 340, 341, 350, and 351.

As shown in FIGS. 4 and 5, there are ten manifolds 310, 311, 320, 321, 330, 331, 340, 341, 350, 351 with five manifolds for each polarization (310, 320, 330, 340, and 350; 311, 321, 331, 341, and 351). The common port of the aforementioned manifolds are coupled to phase shifters 50 and 51 distribution ports via suitably constructed RF wave guides 60*a* to 60*e*; 61*a*, to 61*e*. In addition to a common port, each divider—combiner manifold such as 310 is constructed to have one −3.35 dB and two −6.7 dB distribution ports relative to the common port. For example, manifold ports 310*a*, 311*a*, 320*a*, and 321*a* are −3.35 dB distribution ports, and manifold output ports 310*b*, 310*c*, 311*b*, 311*c*, 320*b*, 320*c*, 321*b* and 321*c* are −6.7 dB distribution ports.

In a preferred embodiment, the two lower antenna elements such as antenna elements 212 and 214 are provided with signal level −6.7 dB below input signal levels. The upper element such as antenna element 210 is coupled to the −3.35 distribution ports of the manifold 310 and 311.

A combination of RF signal distribution and relative antenna elements result in broadband antenna having multi band elements having a HPBW from 40 to 50 degrees. Many variations of the invention will occur to those skilled in the art. All such variations are intended to be within the scope and spirit of the invention.

Figure 7:
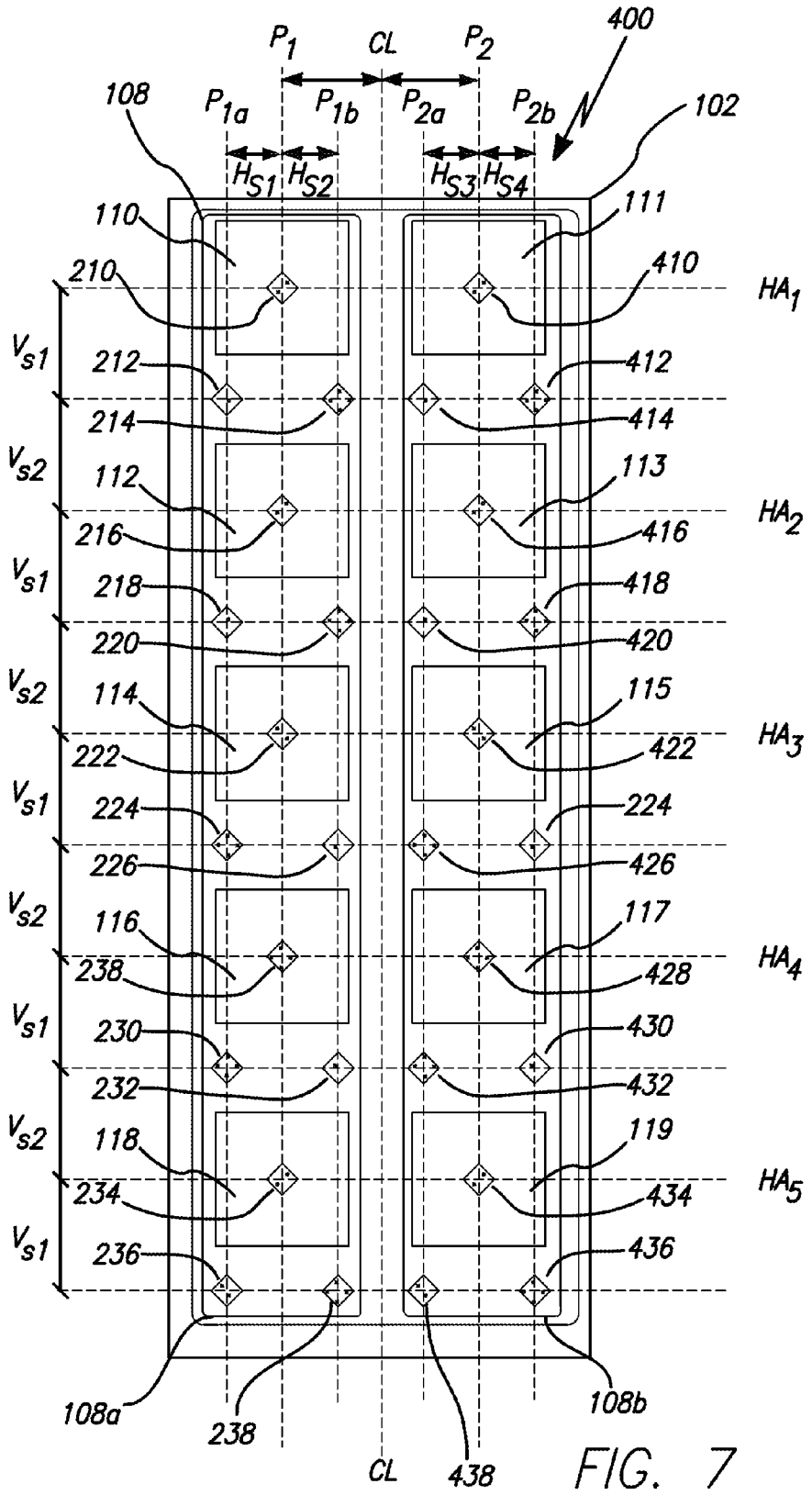
FIG. 7 is a front, boresight view of an exemplary dual broadband antenna for Multiple Input Multiple Output ("MIMO") applications.
Figure 7A:
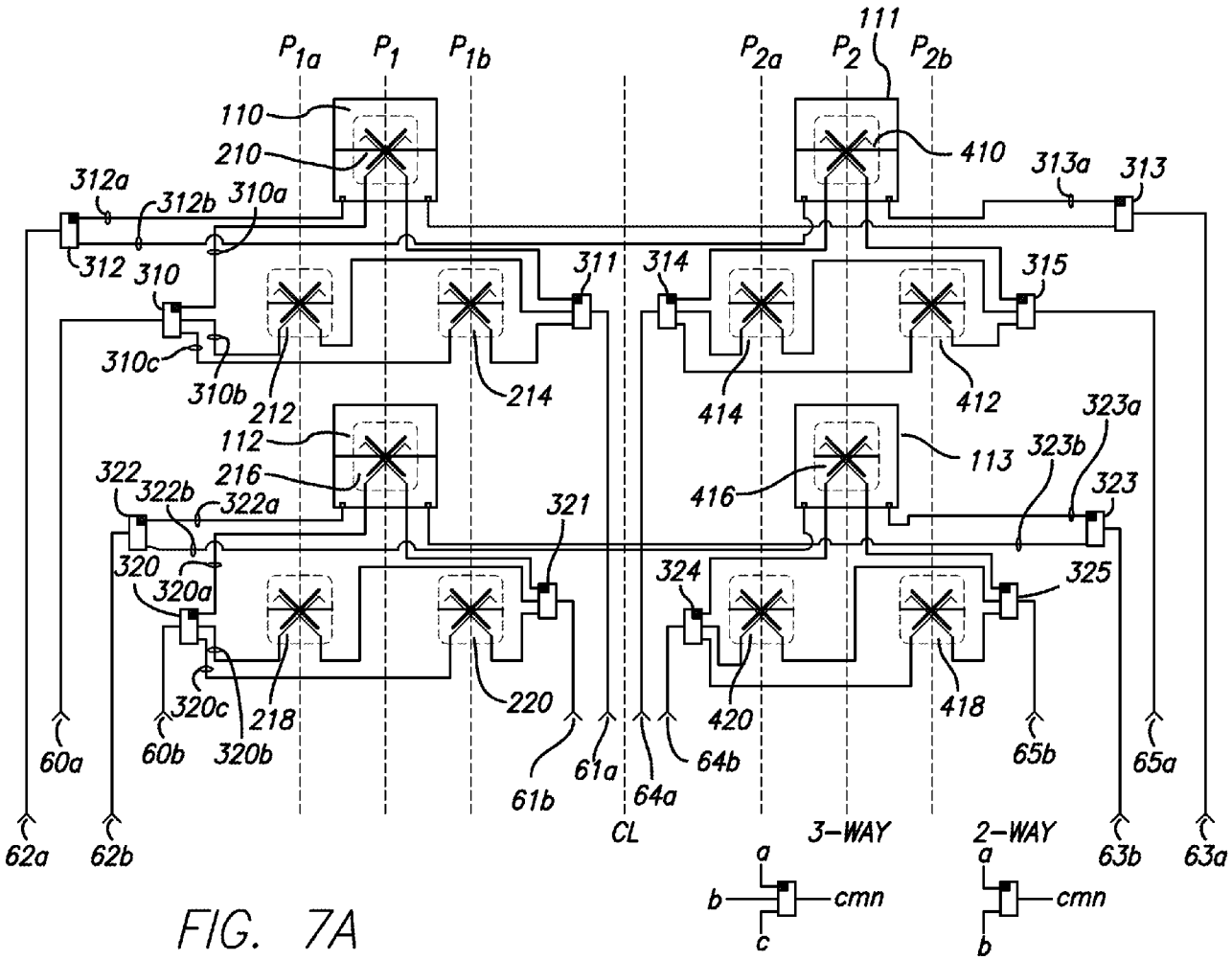
FIG. 7A is a block schematic diagram of a portion of a high and low band antenna element RF feed structure arranged for high band MIMO (from phase shifter to antenna element) shown together for a subset of antenna elements.
Figure 7B:
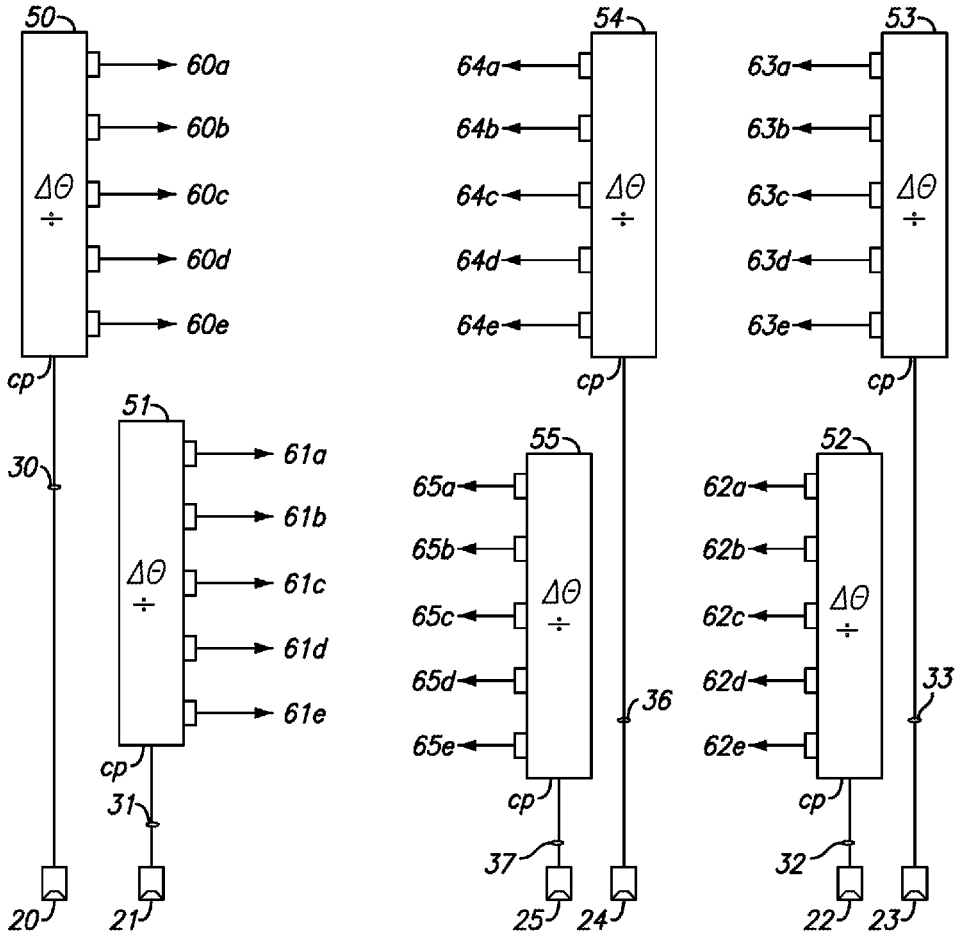
FIG. 7B is a block schematic diagram of phase shifter networks used for beam tilting and main antenna ports.

Multiband antennas as described above may be modified for multiple input multiple output ("MIMO") applications for transmitting and receiving RF signals. With reference to FIGS. 7, 7A, and 7B, a multiband antenna 400 tailored for MIMO will now be described. In an embodiment, dual-polarized, dual band antenna elements groups 108*a* and 108*b* are arranged to radiate in two polarization planes P which are perpendicular with respect to one another and perpendicular to the reflector plane 102 and are positioned longitudinally along major length alignment axes $P_1$, $P_1$, $P_{1b}$, $P_{2a}$, $P_2$, and $P_{2b}$ on the front surface of the radiator arrangement which is rectangular in a plan view. The first antenna element group 108*a* may be similarly configured as elements groups 104*a* and 106*a* as described above. However, for the MIMO configuration, the two columns of antenna elements 108 comprising the previously described first antenna element group 108*a* are used in combination with six antenna ports 20 to 25 and six paired phase shifters 50 to 55 to allow MIMO functionality in the high frequency band forming MIMO capable antenna array arrangement.

As depicted in FIGS. 7A and 7B, each low frequency antenna element such as antenna elements 110-119 have two independent RF ports designated herein as having a suffix "a" or "b" used for coupling the low frequency band RF signals to or from said antenna elements via suitably constructed RF wave guides 62*a*-62*e* and 63*a*-63*e* via two-way RF −3 dB manifolds or splitters 312, 313; 322, 323; 332, 333; 342, 343; and 352, 353. An equal output RF manifold or splitter-combiner networks are well known in art, such as, for example, a Wilkinson divider—combiner, but other well know splitter-combiners can be implemented. The two splitter output ports such as splitter output ports 312*a*, 312*b*, 313*a*, 313*b*, 322*a*, 322*b*, 323*a*, and 323*b* are coupled to the respective antenna elements 110 to 119 feed ports. The two way splitters such as splitters 312, 313; 322, 323; to 352, 353 each have a common port that is coupled to a designated phase shifters 52 and 53 output ports via wave guides 62*a*-62*e* and 63*a*-63*e*. The phase shifters 52 and 53 are preferably adjusted in unison so as to provide identical phase shift to RF signals in wave guides 62*a*-62*e* and 63*a*-63*e* relative to the input and output RF signal at the phase shifter common port 52*cp* and 53*cp*. The phase shifter common ports 52*cp* and 53*cp* are coupled to a corresponding antenna system having RF connectors 22 and 23 coupled to suitably constructed RF guides such as coaxes 32 and 33.

TABLE III

| Group | Antenna Elements | 2-way manifold | Phase shifter ports |
|---|---|---|---|
| 1C | 110 and 111 | 312 and 313 | 62a and 63a |
| 2C | 112 and 113 | 322 and 323 | 62b and 63b |
| 3C | 114 and 115 | 332 and 333 | 62c and 63c |
| 4C | 116 and 117 | 342 and 343 | 62d and 63d |
| 5C | 118 and 119 | 352 and 353 | 62e and 63e |

The first antenna system RF connector 22 is referenced as having a +45 degree polarization and the second antenna system RF connector 23 is referenced as having a −45 degree polarization for the low frequency band together providing polarization diversity.

In an embodiment, an antenna assembly adapted for MIMO systems may use antenna diversity to improve data throughput in multi-path environment. Numerous techniques can be applied to take advantage of MIMO capable antenna systems to improve data throughput such as precoding, spatial multiplexing and diversity coding. One preferred embodiment allows for MIMO operation in the high frequency band by taking advantage of two sets of high frequency antenna elements in element groups 108*a* and 108*b* arranged along two spaced apart longitudinal axes $P_1$ and $P_2$.

The first column of antenna elements group 108*a* comprises dual band antenna elements 110, 210; 112, 216; to 118, 234 arranged along first main longitudinal axis $P_1$. A first group of high frequency antenna elements 212, 218, to 236 are aligned along longitudinal sub-axis $P_{1a}$ to the left of the first main axis $P_1$. A second group of high frequency antenna elements 214, 220, to 238 are aligned along longitudinal sub-axis $P_{1b}$ to the right of the first main axis $P_1$.

The horizontal dual band antenna elements 110, 111; 112, 113; to 118, 119 are arranged along horizontal alignment axes $HA_1$–$HA_5$ spaced by distance $V_{s1}+V_{s2}$ as presented Table IV below.

TABLE IV

| Axis | $P_1$ | $P_2$ |
|---|---|---|
| $HA_1$ | 110 and 210 | 111 and 410 |
| $HA_2$ | 112 and 216 | 113 and 416 |
| $HA_3$ | 114 and 222 | 115 and 422 |
| $HA_4$ | 116 and 228 | 117 and 428 |
| $HA_2$ | 118 and 234 | 119 and 434 |

An identical arrangement may be used for the second column of antenna elements group 108*b*, with elements 111, 410; 113, 416; 115, 422; 117, 428; and 119, 434 arranged along second main longitudinal axis $P_2$. A third group of high frequency antenna elements 412, 418, 424, 430, and 436 are aligned along longitudinal sub-axis $P_{2b}$ to the right of the second main axis $P_2$. A fourth group of high frequency antenna elements (414, 420, 426, 432, and 438) are aligned along longitudinal sub-axis $P_{2a}$ to the left of the second main axis $P_2$.

The first main axis $P_1$ is offset from reflector center line CL by a distance $C_1$ and the second main axis $P_2$ is offset from reflector center line CL by a distance $C_2$. It has been determined that, in most cases, the $C_1$ and $C_2$ dimensions may be the same, but if required, due to a combination of low and high frequency bands, it may be advantageous to have $C_1 \neq C_2$ and/or $H_{s1} \neq H_{s2}$ and $H_{s1} \neq H_{s4}$ to achieve desired antenna system performance characteristics.

The first and second MIMO antenna sub-array generally comprises of first and second columns of antenna elements groups 108*a* and 108*b*. The first column of antenna elements group 108*a* comprises five triplet antenna elements 210, 212, 214; 216, 218, 220; to 234, 236, 238 groups each having antenna element feed port coupled to three way RF divider/combiner 310, 311 and 320, 321 pairs. Table V summarizes element groupings used for first column of antenna elements group 108*a* sub-array.

TABLE V

| Group | Antenna Elements | 3-way manifold | Phase shifter ports |
|---|---|---|---|
| 1A | 210, 212, and 214 | 310 and 311 | 60a and 61a |
| 2A | 216, 218, and 220 | 320 and 321 | 60b and 61b |
| 3A | 222, 224, and 226 | 330 and 331 | 60c and 61c |
| 4A | 228, 230, and 232 | 340 and 341 | 60d and 61d |
| 5A | 234, 236, and 238 | 350 and 351 | 60e and 61e |

Table VI summarizes element groupings used for second column of antenna elements 108*b* sub-array.

TABLE VI

| Group | Antenna Elements | 3-way manifold | Phase shifter ports |
|---|---|---|---|
| 1B | 410, 412, and 414 | 314 and 315 | 64a and 65a |
| 2B | 416, 418, and 420 | 324 and 325 | 64b and 65b |
| 3B | 422, 424, and 426 | 334 and 335 | 64c and 65c |
| 4B | 428, 430, and 432 | 344 and 345 | 64d and 65d |
| 5B | 434, 436, and 438 | 354 and 355 | 64e and 65e |

The beam tilt for the first column high frequency band antenna elements group 108*a* sub-array is controlled with a first and second phase shifters 60 and 61 coupled to the first and second antenna system RF ports 20 and 21 respectively. The beam tilt for second column high frequency band antenna elements group 108*b* sub-array is controlled with fifth and sixth phase shifters 64 and 65 coupled to fifth and sixth antenna system RF ports 24 and 25 respectively. Each pair of phase shifters may have a remotely controllable motor drive mechanism to alter phase shift to provide remote beam tilt control.

Figure 8:
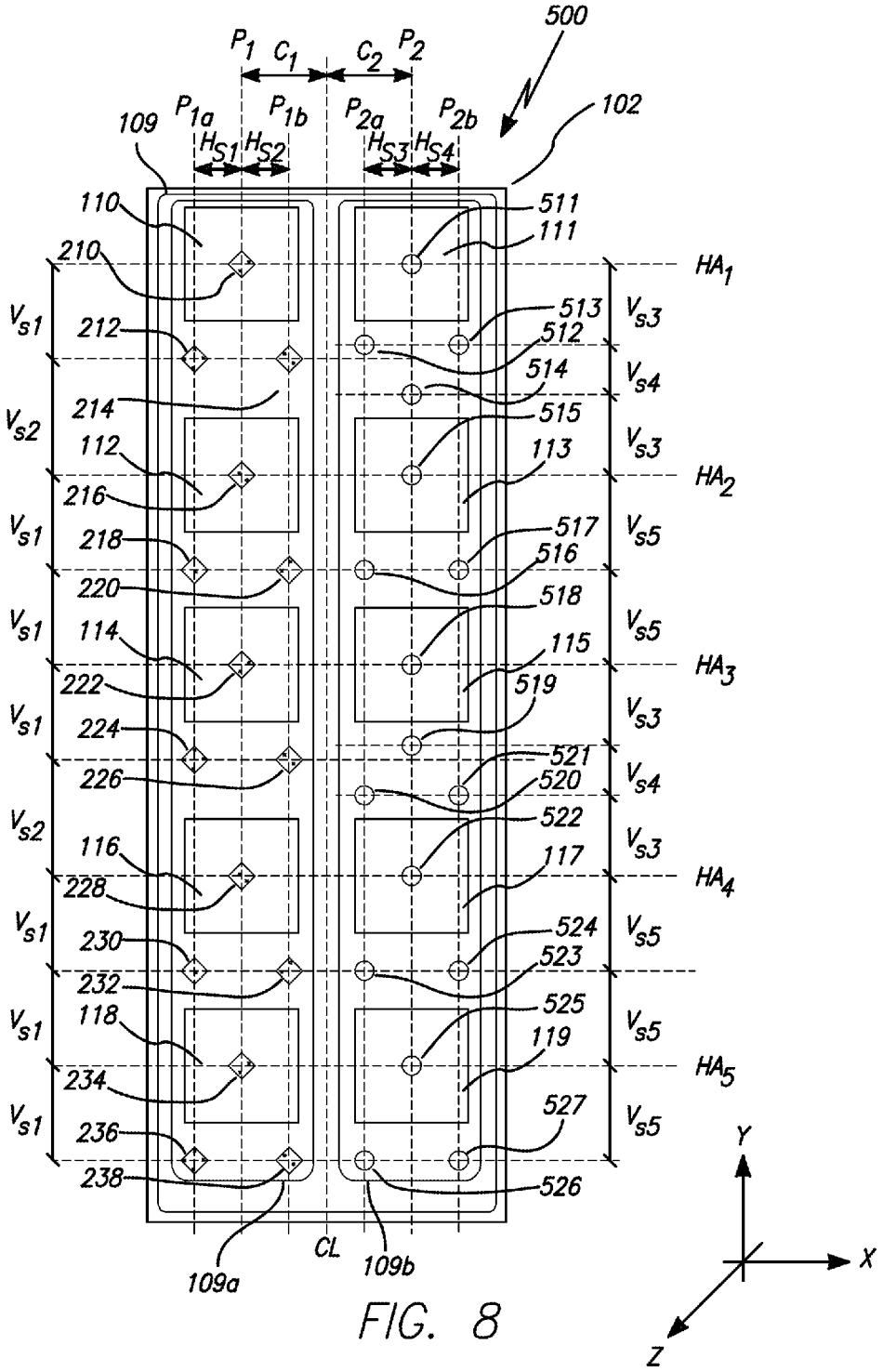
FIG. 8 is a front, boresight view of an exemplary triple-broadband embodiment of the dual broadband antenna.
Figure 8A:
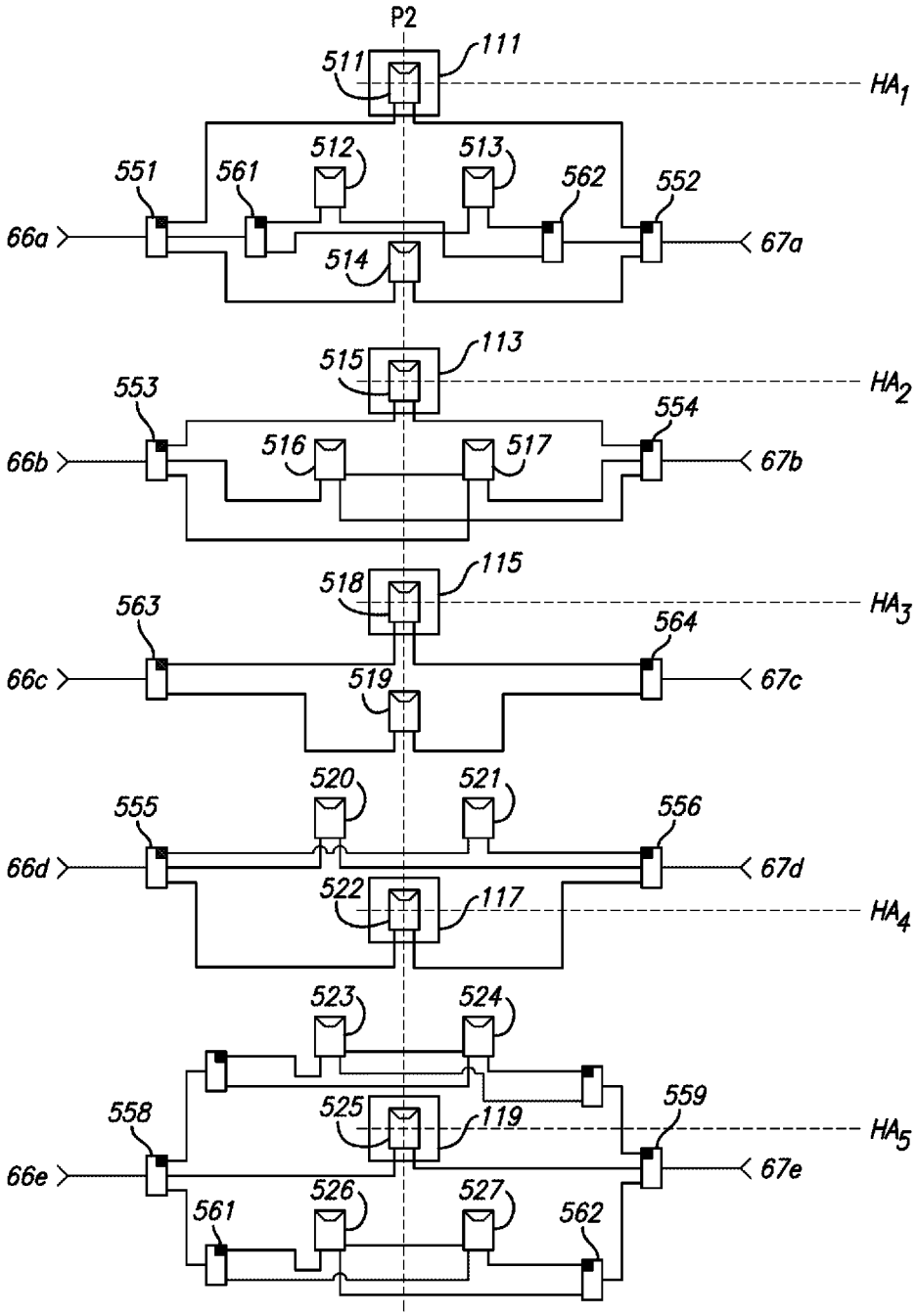
FIG. 8A is a block schematic diagram of an exemplary triple band feed structure for the highest frequency band.
Figure 8B:
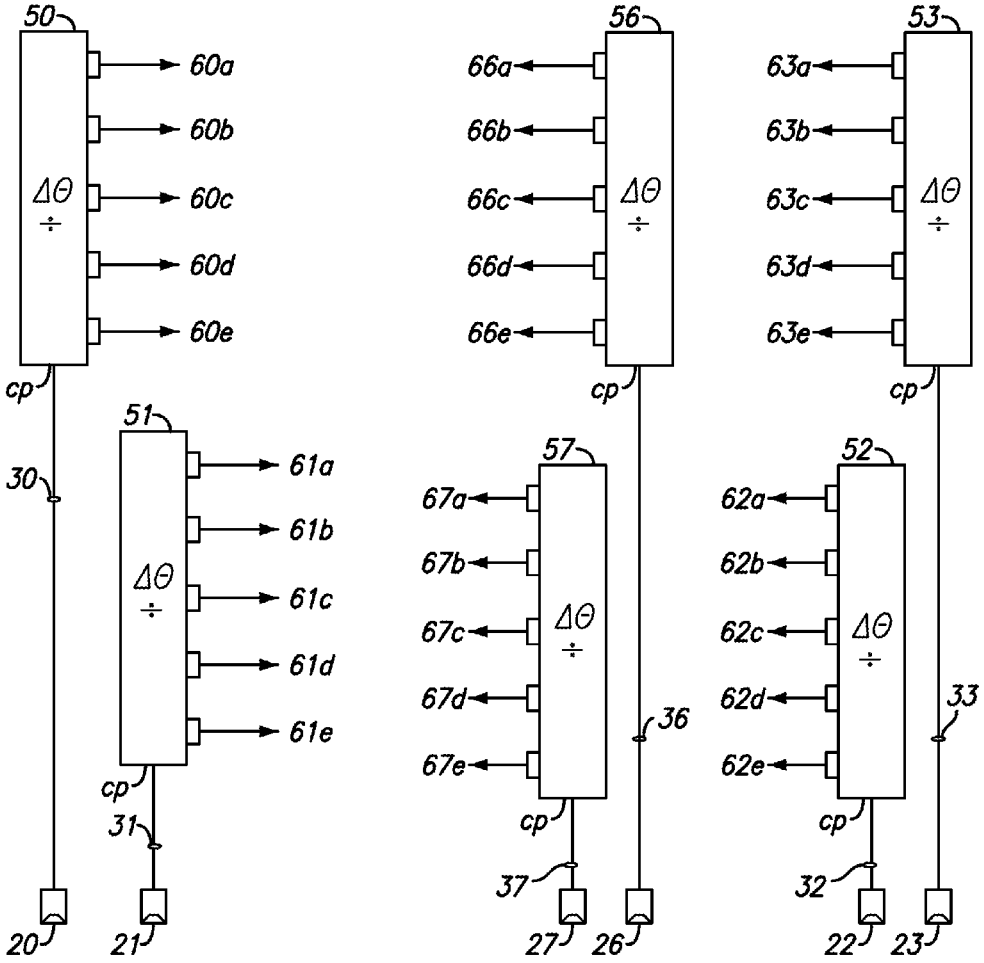
FIG. 8B is a block schematic diagram of exemplary triple band phase shifters for the Hex-Port antenna.

The multiband antennas 100 and 400 as described above may be modified for triple band operation for transmitting and receiving RF signals. With reference to FIGS. 8, 8A, and 8B, the tri-band adaptation multiband antenna 500 will now be described. In the embodiment shown, dual-polarized, dual band antenna elements groups 109*a* and 109*b* are arranged to radiate in two polarization planes P perpendicular with respect to one another and perpendicular to the reflector plane 102 and positioned longitudinally along major length alignment axes $P_1$, $P_1$, $P_{1b}$, $P_{2a}$, $P_2$, and $P_{2b}$ on the front surface of the radiator arrangement which is rectangular in a plan view. The first antenna element group 109*a* may be configured similar to that of antenna elements groups 104*a* and 106*a* described before and to provide HPBW 40 to 50 degrees in the two frequency bands FB2 and FB3.

However the two column antenna array element arrangement can be used in three separate bands, for example FB2=850 MHz, FB3=1900 MHz, and FB5=2600 MHz. An antenna capable of such frequency coverage is referred to as a tri-band antenna and has six antenna RF ports 20, 21, 26, 27, 22, and 23 for ±45 degree polarization. The left most group of antenna element group 109*a* is aligned along axis $P_1$. In the right most column of antenna element group 109*b* positioned along $P_2$, the dual band antenna elements 111, 511, 113, 515, to 119, 525 have been adapted to provide desired antenna pattern characteristics in FB2 and FB5 bands. In addition to FB5 band paired antenna elements, antenna elements 512, 513; 516, 517; 520, 521; 523, 524; 526, 527 interposed between the dual band elements 111, 511; 113, 515; to 119, 525 and below the last dual band 119 and 525 antenna elements.

A single FB5 band antenna element 514 is placed on the $P_2$ axis between second dual band antenna element 113 and 515 and first FB5 band paired antenna elements 512 and 513. Another single FB5 band antenna element 519 is placed above the third FB5 band paired antenna elements 520, 521 and below the third dual band antenna elements 115 and 518. The five horizontally paired FB5 band antenna elements 512, 513; 516, 517; 520, 521; 523, 524; and 561, 562 provide narrow HPBW (i.e., 26 to 38 degrees for example) beamwidth. When combined with non horizontally paired antenna elements 511, 514, 515, 518, 519, 522, and 525 each having 65 degree HPBW results in an antenna array that has 45 degree HPBW. Inclusion of the aforementioned two single FB5 band antenna elements 514 and 519 improves HPBW over the FB5 band without effecting performance of the low frequency antenna array (i.e. elements 110 to 119) while providing excellent vertical sidelobe control. However, these additional FB5 band antenna elements 514 and 519 introduce somewhat of unique feed structure as shown in FIG. 8A and summarized in a Table VII below.

TABLE VII

| Group | Antenna Elements | 2-way manifold | 3-way manifold | Phase shifter ports |
|---|---|---|---|---|
| 1C | 511, 512, 513, and 514 | 561 and 562 | 551 and 552 | 66a and 67a |
| 2C | 515, 516, and 517 | | 553 and 554 | 66b and 67b |
| 3C | 518 and 519 | 563 and 564 | | 66c and 67c |
| 4C | 520, 521, and 522 | | 555 and 556 | 66d and 67d |
| 5C | 523, 524, 525, 526, and 527 | 565, 561, 566, 562 | 558 and 559 | 66e and 67e |

Five antenna element groups are used along horizontal alignment axes $HA_1$–$HA_5$. For dual band antenna elements 111, 511; 113, 515; to 119, 525, the low frequency FB2 feed structure was previously discussed in above with respect to multiband antenna 100 illustrated in FIGS. 3 and 5 and may be retained in a third preferred embodiment. Since the right most column compromises of new set of dual band (i.e., FB2, FB5) elements 111, 511; 113, 515; to 119, 525, the feed structure for the FB5 band antenna elements 511, 512 to 527 is modified slightly to take advantage of additional antenna elements 514, 519.

For tri-band beam tilt control in each of the respective frequency bands (i.e., FB2, FB3, and FB5), phase shifter pairs 52, 53; 50, 51; and 56, 57 may be controlled independently from each other. RF signals to and from the tri-band antenna system for each respective frequency band FB2, FB3, and FB5 are coupled from RF common ports 22, 23; 20, 21; 26, 27 respectively.

Although some embodiments are shown to include certain features, the applicant(s) specifically contemplate that any feature disclosed herein may be used together or in combination with any other feature on any embodiment of the invention. It is also contemplated that any feature may be specifically excluded from any embodiment of an invention.

The present invention has been described primarily as methods and structures for antenna systems. Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An antenna assembly, comprising:

a reflector;

an array of first frequency band radiating elements configured above the reflector, the elements arranged in one or more columns extending in a first direction;

a plurality of second frequency band radiating elements configured above the reflector including first and second sub groups, each of the first sub group of radiating elements essentially co-located with a corresponding first frequency band radiating element, and wherein the second sub group of radiating elements are configured outside of the first frequency band radiating elements, the second sub group offset with respect to the first sub group of radiating elements in the first direction, wherein the first and second sub groups of radiating elements comprise a plurality of commonly-fed elements of a series of radiating triplets, wherein each of the series of radiating triplets is configured in triangular relationship, and wherein the series of radiating triplets comprise dual band radiating elements, to provide a desired horizontal plane beamwidth; and an RF feed network coupled to each radiating element of the first and second sub groups, the RF feed network providing a first communication signal having a first power level to the first sub group, the RF feed network providing a second communication signal having a second power level differing from the first power level to the second sub group, wherein the operating frequency of the first frequency band radiating elements is lower than the operating frequency of the second frequency band radiating elements, and the first power level is different from the second power level to compensate for increased beamwidth caused by co-location of each of the first subgroup of radiating elements with the corresponding first frequency hand radiating element.

2. An antenna assembly as set out in claim 1, wherein the first and second sub groups of radiating elements are arranged in three columns.

3. An antenna assembly as set out in claim 1, wherein the first power level is greater than the second power level.

4. An antenna assembly as set out in claim 1, wherein the array of first frequency band radiating elements is arranged in two columns.

5. An antenna assembly as set out in claim 1, wherein the first power level is approximately −3.3 dB below an RF input level and the second power level is approximately −6.7 dB below the RF input level.

6. An antenna assembly as set out in claim 1, wherein the RF feed network further comprises:

a phase shifter receiving a first input signal and outputting a phase adjusted signal; and, a plurality of first divider-combiner manifolds receiving the phase adjusted signal and outputting the first communication signal having the first power level to the first sub group, the first divider-combiner manifolds outputting the second communication signal having the second power level to the second sub group.

7. An antenna assembly as set out in claim 1, wherein the first and second sub groups of radiating elements are each coupled to two independent high frequency radio frequency ("RF") ports and the array of first frequency band radiating elements are each coupled to two lower frequency RF ports.

8. An antenna assembly as set out in claim 1, wherein the second sub group of radiating elements are configured as elements of a series of radiating doublets having a radiating emission pattern narrower than that of the first sub group of radiating elements.

9. An antenna assembly as set out in claim 1, wherein the radiating elements of the first and second sub groups collectively provide a radiation pattern of about 40-50 degrees Half Power Beamwidth.

10. An antenna assembly, comprising:

a reflector;

an array of first frequency band radiating elements configured above the reflector, the array arranged in pairs forming first and second columns both having lengths in a first direction;

a plurality of second frequency band radiating elements including a first sub group of radiating elements configured above the reflector, the first sub group of radiating elements arranged as a column having a length in the first direction, each of the first sub group of radiating elements essentially co-located with a corresponding radiating element of the first column of the array of first frequency band radiating elements, and a second sub group of radiating elements configured above the reflector arranged in pairs forming two columns on either side of the first sub group of radiating elements in a direction orthogonal to the first direction, the second sub group positioned outside corresponding radiating elements of the first column of the array of first frequency band radiating elements; and, a plurality of third frequency band radiating elements including a third sub group of radiating elements configured above the reflector, the third sub group arranged as a column having a length in the first direction, each of the third sub group of radiating elements essentially co-located with a corresponding radiating element of the second column of the array of first frequency band radiating elements, and a fourth sub group of radiating elements configured above the reflector as an array arranged in pairs forming two columns on either side of the third sub group of radiating elements in a direction orthogonal to the first direction, the fourth sub group positioned outside corresponding radiating elements of the second column of the array of first frequency band radiating elements, wherein the operating frequency of the second and third frequency band radiating elements is higher than the operating frequency of the first frequency band radiating elements.

11. An antenna assembly as set out in claim 10, further comprising:

an RF feed network coupled to each radiating element of the first, second, third, and fourth sub groups, the network providing a first communication signal having a first power level to the first sub group, the network providing a second communication signal having a second power level differing from the first power level to the second sub group, the network providing a third communication signal having a third power level to the third sub group, the network providing a fourth communication signal having a fourth power level differing from the third power level to the fourth sub group.

12. An antenna assembly as set out in claim 11, wherein the first power level is greater than the second power level and the third power level is greater than the fourth power level.

13. An antenna assembly as set out in claim 10, wherein the operating frequency band of the first and second sub groups is the same as the operating frequency band of the third and fourth sub groups.

14. An antenna assembly as set out in claim 10, wherein the operating frequency band of the first and second sub groups differs from the operating frequency band of the third and fourth sub groups.

15. An antenna assembly as set out in claim 13, wherein the first and second sub groups of radiating elements and third and fourth sub groups of radiating elements each have collectively a radiating emission pattern of about 40-50 degrees Half Power Beamwidth.

16. An antenna assembly as set out in claim 15, wherein the second and fourth sub groups of radiating elements are configured as commonly-fed elements of a series of radiating doublets having a radiating emission pattern narrower than that of the first and third sub groups of radiating elements.

17. An antenna assembly as set out in claim 10, wherein the first and second sub groups of radiating elements are configured as commonly-fed elements of a first series of radiating triplets, wherein the third and fourth sub groups are configured as commonly-fed elements of a second series of radiating triplets, and wherein a plurality of the radiating elements provide a desired horizontal plane beamwidth.

18. An antenna assembly as set out in claim 10, wherein the radiating elements of the first, second, third, and fourth sub groups comprise patch elements.

19. A method of operating a multi band antenna comprising an array of low band radiating elements, a first set of high hand radiating elements each co-located within a corresponding low band radiating element, and a second set of high band radiating elements positioned outside the low band radiating elements, the method comprising:

providing a first frequency RF communication signal to the array of low band radiating elements;

providing a second higher frequency RF communication signal having a first power level to the first set of high band radiating elements each co-located with a corresponding low hand radiating element;

providing the second higher frequency RF communication signal having a second power level to a second set of high band radiating elements positioned outside the low band elements, wherein the first power level differs from the second power level to compensate for increased beamwidth caused by co-location of the first set of high band radiating elements with corresponding low band radiating elements; and configuring a plurality of the first set of high band radiating elements and the second set of high band of radiating elements as commonly-fed elements of a series of radiating triplets each configured in triangular relationship, and wherein the series of radiating triplets comprise dual band radiating elements, to provide a desired horizontal plane beamwidth.

* * * * *